United States Patent [19]

Chalabian

[11] 4,067,477

[45] Jan. 10, 1978

[54] SINGLE ARTICLE VENDING MACHINE

[75] Inventor: Jack S. Chalabian, Huntington Beach, Calif.

[73] Assignee: K-Jack Engineering Company, Inc., Gardena, Calif.

[21] Appl. No.: 697,715

[22] Filed: June 21, 1976

[51] Int. Cl.[2] ..... G07F 11/44

[52] U.S. Cl. ..... 221/1; 194/2; 221/155; 221/241

[58] Field of Search ..... 221/1, 33, 44, 45, 155, 221/226, 241, 279, 227; 194/2, 22, 37, 48, 51, 57, 59, 63, 65, 68, 75, 79, 88

[56] References Cited

U.S. PATENT DOCUMENTS

| | | | |
|---|---|---|---|
| 3,747,733 | 7/1973 | Knickerbocker | 221/241 X |
| 3,768,695 | 10/1973 | Pearson | 221/227 |
| 3,905,530 | 9/1975 | Emmel | 221/155 |

*Primary Examiner*—Robert B. Reeves
*Assistant Examiner*—Joseph J. Rolla
*Attorney, Agent, or Firm*—George F. Smyth

[57] ABSTRACT

A single article vending machine having a chamber for storing a plurality of articles in stacked relation and an opening which provide an adjustable opening in communication with the articles. An adjustment mechanism is provided to adjust the opening to a dimension which corresponds with the thickness of one of the articles and locking assemblies are provided to lock the opening. The locking assemblies to lock the adjustable opening include a plurality of locking members which are movable into the opening to block the opening. An actuating assembly is provided to move the locking members out of the opening such that the opening is unlocked to permit the withdrawal of one article through the opening. Stop members which are actuatable by the movement of one of the articles through the opening function to move the locking members into the opening as the article is moved through the opening. Thus, a single article may be dispensed through the opening with the passage of the article through the opening moving the locking members into the opening to prevent the withdrawal of a second article through the opening.

50 Claims, 10 Drawing Figures

SINGLE ARTICLE VENDING MACHINE

BACKGROUND OF THE INVENTION

Many articles, such as newspapers, magazines, etc., are dispensed from vending machines. Such vending machines customarily include a display cabinet having a lockable door which may be opened by inserting a suitable combination of coins into a coin mechanism associated with the display cabinet. When the door to the display cabinet is opened, a magazine or newspaper may be withdrawn from the display cabinet with the door then being returned to its locked position.

Present vending machines do offer some protection against theft through the use of the protective display cabinet which surrounds the articles that are being vended. However, present vending machines are ineffective in preventing the withdrawal of more than one article from the display cabinet after the door to the cabinet has been unlocked. Thus, a user may insert the correct change to purchase a single article from the machine which permits opening of the door to the cabinet. However, after opening the door, the user may then remove all of the articles from the vending machine. Thus, such present vending machines offer no protection, whatsoever, against the removal of more than one article by the user.

The profit margin to an owner of vending machines, for articles such as newspapers, may be relatively small. Thus, to earn a living, the vending machine owner may have to place a relatively large number of vending machines in areas frequented by the public. Then, even with a small profit margin, the vending machine owner may be able to make a reasonable living through increasing his sales volume.

In servicing a relatively large number of vending machines to increase sales volume, the vending machine owner may not be able to keep any one machine under surveillance to guard against the removal of more than ore article from a vending machine by the purchasers. This being the case, it is surprising that the owners of newspaper and magazine vending machines are able to survive since the business of the vending machine owner depends completely on the general honesty of the public in removing only one article from the vending machine during its operation.

Even though the general public may be reasonably honest in the use of newspaper and magazine vending machines, a relatively small percentage of thievery can wreak havoc with the profit margin of the vending machine owner. For example, if the owner of the vending machine has a profit margin of 2 cents on the sale of a 15 cent newspaper, the owner must invest 13 cents for each newspaper that is vended. For each newspaper that is stolen, the vending machine owner must, then, sell seven newspapers to recoup the loss on the stolen newspaper.

A newspaper vending machine may contain a relatively large number of newspapers, such as 50 or 100 newspapers, depending upon the size of the newspaper and the size of the vending machine. If a vending machine which contains, for example, 100 newspapers, is rifled by a thief who only pays for one newspaper, the vending machine owner may then have to sell approximately 700 newspapers to make up for the loss incurred by the theft. This could impose a very heavy burden on the newspaper vendor's business. Further, if such losses were of a recurring nature, they could, in time, force the newspaper vendor out of business.

In view of the above considerations, there is presently a need for a vending machine which would function to vend only a single article such as a newspaper or magazine. Such a machine would eliminate the present problems which plague newspaper and magazine vendors in which the opening of a vending machine can result in the theft of all of the articles in the machine.

Further, there is a need for a single article vending machine in which the opening through which the article is withdrawn can be varied in dimension to accommodate articles of varying thickness. For example, in the vending of newspapers, the thickness of the newspaper may vary from day-do-day depending upon the volume of classified advertising. Also, there will generally be a radical difference between the thickness of a Sunday newspaper and the thickness of a daily newspaper. By varying the dimension of the opening through which a single article is withdrawn, the opening can be adjusted to precisely fit the thickness of the single article which is being dispensed. Thus, the opening may be enlarged to fit the thickness of a Sunday newspaper or may be varied from one day to the next to accommodate daily newspapers of varying thickness. This would then provide the necessary flexibility for a single article vending machine in which the thickness of the article being dispensed may vary from one day to the next.

SUMMARY OF THE INVENTION

In providing a solution to the aforementioned problems concerning the theft of articles from vending machines, such as newspapers and magazines, I have provided a vending machine which is extremely flexible and which functions to vend only a single article with each vending operation. Further, my machine is capable of vending articles of varying thickness such as relatively thick articles, e.g., Sunday newspapers, or relatively thin articles, such as a daily newspaper having a minimum of classified advertising.

The present single article vending machine may include means for storing a plurality of articles in stacked relation and means which provide an adjustable opening in communication with the articles. Means may be provided to adjust the opening to a dimension which corresponds with the thickness of one of the articles being dispensed with means to lock the opening to prevent the withdrawal of more than one article through the opening.

The means to lock the adjustable opening may include a plurality of locking members which are movable into the opening to lock the opening. Further, means may be provided to move the locking members out of the opening to unlock the opening and to permit the withdrawal of one article through the opening. During the movement of one article through the opening, means are provided which are actuatable by movement of the article to move the locking members into the opening as the article is moved through the opening. Accordingly, a single article may then be dispensed through the opening with the locking members moved out of the opening. However, on passage of the article through the opening, the locking members are moved into the opening to prevent the withdrawal of a second article.

In the present vending machine, an enclosure may be positioned about the adjustable opening with the enclosure having a door. A coin mechanism may be provided which permits opening the door when a predetermined number or denomination of coins is received by the coin mechanism. Further, means may be provided which interconnect the movement of the door with the means to move the locking members out of the opening. Thus, the locking members may be positioned out of the opening each time the door to the enclosure is opened through the insertion of coins in the coin mechanism.

In positioning the locking members out of the adjustable opening to permit the dispensing of a single article, means may be provided to hold the locking members out of the opening. Further, means may be provided to interconnect the means to hold the locking members out of the opening with the means which are actuatable by movement of one article through the opening. Thus, the means to hold the locking members out of the opening may be actuated by the movement of one article through the opening. This may, then, permit the movement of the locking members into the opening to lock the opening and to prevent the withdrawal of a second article through the opening.

In initiating the movement of a single article through the opening, means may be provided to permit access to a portion of one of the articles. The article may then be grasped and pulled through the opening when the opening is unlocked and the locking members are positioned out of the opening. Further, means may be provided to prevent access to the articles to be dispensed during the time that one of the articles is being withdrawn through the opening. Thus, access may be provided to a portion of one of the articles to permit grasping of the article in initiating its movement through the opening. However, as the article is withdrawn through the opening, access to the articles may then be prevented such that grasping of a second article is not permitted.

In the present vending machine, the locking members may be individually actuatable such that one of the locking members may move into the opening to lock the opening while other of the locking members are positioned out of the opening. By functioning in this manner, the locking members may not be maintained out of the opening merely by exerting a force against one of the locking members to hold it out of the opening. Thus, the opening may not be maintained in an unlocked condition merely by maintaining one of the locking members in a position out of the opening.

In the present single article vending machine, the means to lock the adjustable opening may include a plurality of locking fingers which are positioned for movement into or out of the opening. In controlling the movement of the locking fingers, a rotatable shaft may be provided in which a plurality of toggle levers are connected to the shaft. Means may be provided to bias the locking fingers for movement into the adjustable opening with a plurality of stop members being movable between a first position in contact with the locking fingers to hold the fingers out of the opening and a second position out of contact with the fingers such that the fingers extend into the adjustable opening. Means may be provided to bias the stop members toward the first position with the toggle levers coacting with the locking fingers such that rotation of the shaft in one direction may move the locking fingers out of the opening. The stop members may then move to the first position to hold the fingers in a retracted position out of the opening.

Additionally, the stop members may extend into the opening with the stop members in the first position. The stop members may then be movable to the second position when contacted by an article which is being withdrawn through the opening. Movement of an article through the adjustable opening may, thus, move the stop members to the second position such that the fingers move into the opening to lock the opening and to prevent the withdrawal of a second article.

In movement of the rotatable shaft in one direction to move the locking fingers out of the opening, means may be provided to bias the shaft in the one direction. Thus, on rotation of the shaft in the one direction to withdraw the locking fingers from the adjustable opening, the rotational position of the shaft may remain fixed with the locking fingers being positioned out of the opening. Further, means may be provided to prevent the retraction of the locking fingers out of the adjustable opening without rotation of the shaft which carries the toggle levers. Thus, the adjustable opening may not be unlocked by exerting a force against the locking fingers in an attempt to move the fingers out of the opening. Rather, the only means for retracting the locking fingers from the opening may require rotation of the shaft such that the toggle levers coact with the locking fingers to withdraw the fingers from the opening.

In addition, the present vending machine may include a plurality of lock levers with each lock lever being pivotally conected at one end to a toggle lever. Further, each lock lever may be pivotally connected at another end to a locking finger with a locking member being positioned for contact with the lock levers. The toggle levers may then be shaped and positioned to move the lock levers into locking proximity with the locking member on rotation of the shaft in a direction opposite to said one direction. On movement of the stop members to their second position, the locking fingers may, thus, move into the adjustable opening to provide rotation of the shaft in a direction opposite to said one direction. This may, then, move the lock levers into locking proximity with the locking member. The locking fingers may then not be removed from the adjustable opening through the application of a force thereto since this is prevented by contact of the lock levers with the locking member.

In the present vending machine, the locking fingers may be individually actuatable. Thus, one of the locking fingers may undergo movement into the adjustable opening to lock the opening on movement of the stop member for that finger to its second position. However, at the same time, other of the locking fingers may remain in a retracted position out of the adjustable opening with the stop members for these fingers being positioned in their first position.

To provide for individual actuation of the locking fingers, means may be provided which interconnect the lock levers with the toggle levers carried by the rotatable shaft to permit the movement of the lock levers for locking fingers positioned out of the opening, with the lock levers for these fingers being moved to a position which is not in locking proximity with the locking member. However, at the same time, the lock levers for fingers which have moved into the adjustable opening may be moved into locking proximity with the locking member. Thus, those locking fingers which have moved into the adjustable opening may not be retracted from the opening through application of a direct force thereto because of opposition to this movement which is provided by contact between the lock levers for these fingers with the locking member.

In addition to a single article vending machine, as described above, the present invention provides a protective lockable cover which may be inserted within a vending machine to convert the vending machine to a single article vending machine. The protective lockable cover may include a cover member, a movable base member positioned in spaced relation to the cover member, and means to adjust the spacing between the cover member and the base member to provide an opening therebetween which has a dimension that corresponds with the thickness of one of a plurality of articles to be dispensed one at a time through the opening.

Additionally, the protective lockable cover may include means to lock the adjustable opening which includes a plurality of locking members that are movable into the opening to lock the opening. Means may be provided to move the locking members out of the opening to unlock the opening and to permit the withdrawal of one article through the opening. Additionally, means actuatable by the movement of one article through the opening may be provided to move the locking members into the opening as the one article is moved through the opening. Thus, a single article may be dispensed by being withdrawn through the adjustable opening with the locking members positioned out of the opening. However, on passage of the single article through the opening, the locking members may be moved into the opening to prevent the withdrawal of a second article through the opening.

In a still further aspect of the present invention, a method is provided for dispensing articles one at a time in a vending operation. In accordance with the method, an adjustable opening is provided to a region which contains a plurality of articles to be dispensed. The opening may then be adjusted to provide the opening with a dimension which corresponds to the thickness of one of the articles. The opening may then be locked by moving a plurality of locking members into the opening to block the opening. In dispensing an article through the opening, the locking members may be moved out of the opening to unlock the opening and to permit the withdrawal of a single article through the opening. Then, a single article may be grasped and withdrawn through the opening with the locking members being returned into the opening on passage of the article through the opening.

BRIEF DESCRIPTION OF THE DRAWINGS

To illustrate a specific embodiment of the invention, reference is made to the accompanying drawings in which.

DETAILED DESCRIPTION

Figure 1:
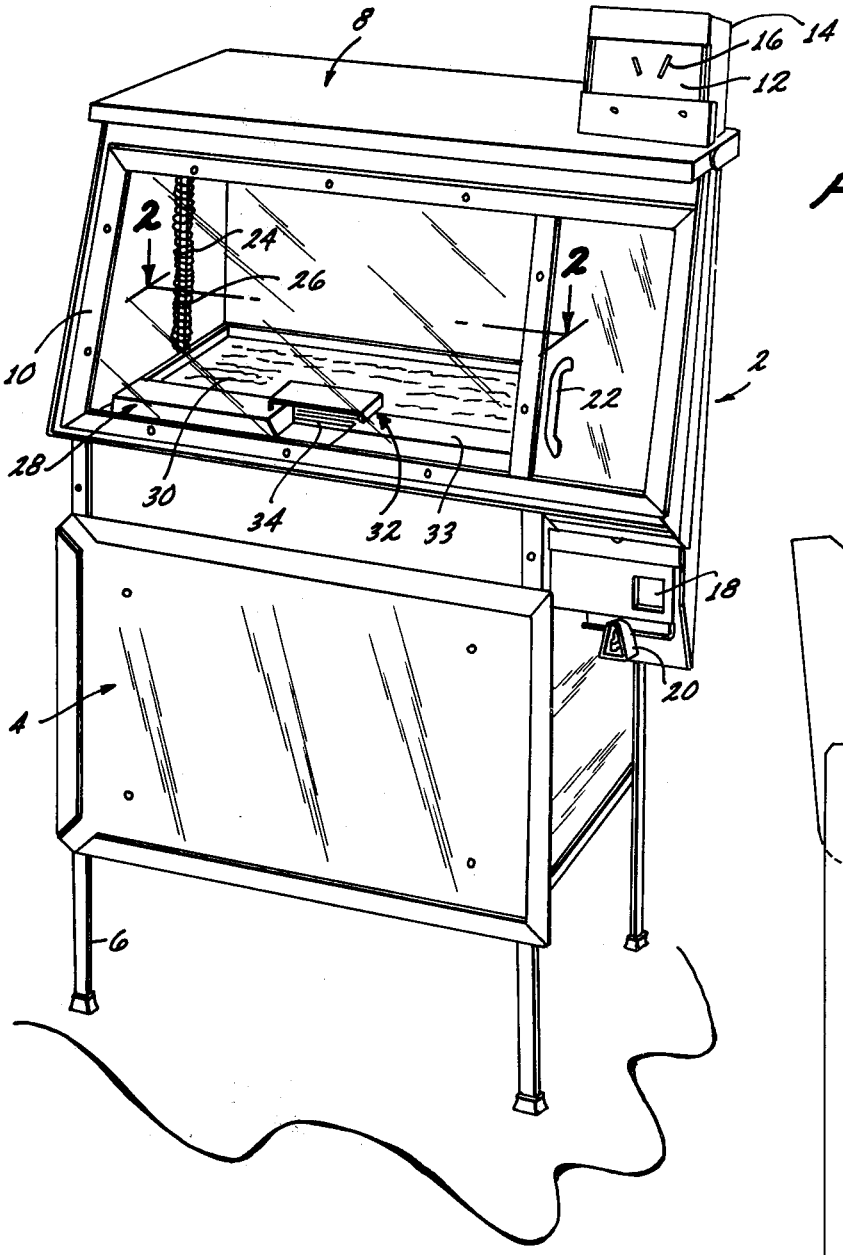
FIG. 1 is a perspective view of a single article vending machine in which a plurality of newspapers may be positioned beneath a protective cover within a display cabinet such that only one article at a time may be withdrawn through an opening beneath the protective cover during a single vending operation.

FIG. 1 is a pictorial view of a single article newspaper vending machine 2 having a storage compartment 4 which is supported on a plurality of legs 6. A display cabinet 8 is positioned above the storage compartment 4 such that newspapers may be supplied from the storage compartment to the display cabinet for dispensing. The display cabinet 8 may include a door 10 which is opened during dispensing of newspapers with opening of the door being controlled by a coin mechanism 12 which may be partially surrounded by a protective shroud 14.

The coin mechanism 12 may be of any construction in which a particular number or combination of coins is inserted through coin slots 16 to actuate the mechanism and to permit opening of the door 10. Thus, for example, the coin mechanism 12 may be of the type described in my prior U.S. Pat. No. 3,884,330. However, the present vending apparatus does not require a particular coin mechanism and the nature of the coin mechanism 12 is not a part of the present invention.

Similarly, it is not necessary that the coin mechanism 12 be surrounded by a protective shroud, such as shroud 14, since the structure of the coin mechanism 12 and whatever means may be used to protect the coin mechanism do not form a part of the present invention. If present, the protective shroud 14 may, thus, be of the type described in my prior copending application, Ser. No. 687,881 which was filed in the Patent and Trademark Office on May 19, 1976. The coin mechanism 12 may include a conventional coin return 18 and also a lock protector 20 of the type generally described in my prior copending application, Ser. No. 687,881. However, the use of a lock protector, such as protector 20, is not a part of the present invention and is disclosed only as background information.

The door 10 may include a handle 22 to open the door after the correct number and/or combination of coins is inserted into the coin slots 16. Posts 24 which may be surrounded by coil springs 26 may provide an upward biasing force to newspapers in the storage compartment 4 so that newspapers may be dispensed, one at a time, from the vending machine 2 until the storage compartment is emptied. In dispensing a single newspaper from the vending machine 2, a cover 28 may be positioned within the display cabinet 8 such that newspapers within the storage compartment 4 are biased upwardly against the cover. The cover 28 may include a high impact resistant glass or plastic member 30 which is transparent such that the cover page of the newspaper is visible from the exterior of the display cabinet 8. p With the door 10 in an opened position, a lid 32 may be raised so that one newspaper may be grasped and withdrawn from beneath the cover 28. Plates 33 may be positioned on either side of the lid 32 to protect the mechanism within the cover 28 from tampering. Also, in withdrawing a single newspaper from beneath the cover 28, a hand slot 34 may be provided to permit access to the newspaper which is being withdrawn. The hand slot 34 may, thus, coact with the lid 32 with the lid being tilted to a raised position during the withdrawal of a newspaper.

Figure 2:
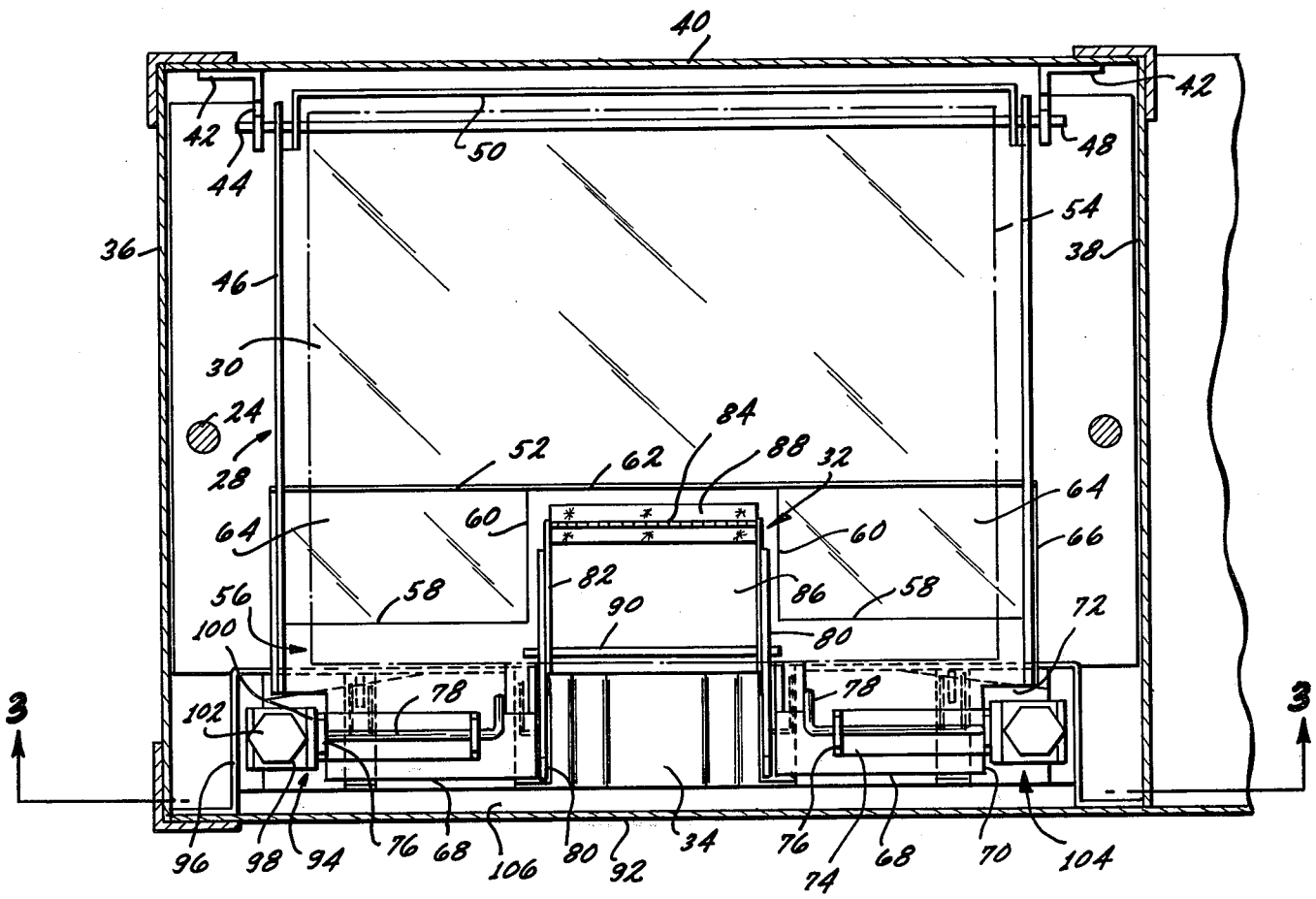
FIG. 2 is a plan view of the protective cover for the vending machine taken along section line 2—2 of FIG. 1 in which portions of the vending machine are shown in sectional view.

FIG. 2 is an enlarged plan view of the cover 28 taken along the section line 2—2 of FIG. 1 to illustrate, in greater detail, the manner in which the cover functions. As illustrated, the display cabinet 8 may include sidewalls 36 and 38 and a back wall 40 which may have mounting brackets 42 secured thereto in any suitable manner. The mounting brackets 42 may each include a hook 44 with side members 46 on the cover 28 being connected by a rod 48 that rotatably engages the hooks. Additionally, the cover 28 may include a rear member 50 which is also positioned between side members 46 to provide additional support between the side members. Also, a cross brace 52 may extend between the side members 46 with a stack of newspapers 56 being indicated in phantom line drawing beneath the cover 28.

A cross frame 56 may then join the forward ends of the side members 46 with the cross frame having a generally U-shaped configuration which forms transverse edges 58, longitudinal edges 60, and a transverse edge 62 which may be joined in any suitable manner to the cross brace 52. Transparent members 64, which may be formed of high-impact glass or plastic, may then be placed within the regions bounded by the cross frame 56 and the cross brace 52 with the transparent members providing a greater view of the cover page of a newspaper 54 positioned beneath the cover 28. The cross frame 56 may also define front edges 68 and side edges 66 which may project slightly beyond the side members 46. At either end of the front edges 68, cut-out portions may be formed with the cut-out portions defining an edge 70 and an edge 72 positioned at approximate right angles thereto. U-brackets 74 may then be fixedly secured to the upper surface of the cross frame 56 with the U-brackets defining upstanding portions 76 within which support rods 78 may be removably secured. The support rods 78 may be supported within apertures formed in the upstanding portions 76 with the support rods functioning to fix the height of the cover 28 so as to allow only one newspaper of a given thickness to be withdrawn from beneath the cover.

The lid 32 may include lock members 80 rotatably secured to side members 82 of the lid with the lock members functioning to prevent the lid cover 86 from being maintained in a raised position during withdrawal of a single newspaper 54 from beneath the cover 28. This is a further safety precaution to ensure that only one article, such as a newspaper, may be dispensed at a time. Additionally, the side members 82 may be interconnected with a hinge 84 having flanges 88 which may be affixed in any suitable manner to the upper surface of the cross frame 56. A shaft 90 may also extend between the side members 82 and be retained within apertures in the side members and within apertures in the lock members 80 to control the rotational position of the lock members with respect to the rotational position of the side members.

A front wall 92 of the storage compartment 4 (see FIG. 1) may be positioned in spaced relation with respect to the front edges 68 on the cross frame 56. A lock assembly 94 may then be positioned beneath the cross brace 56 with the lock assembly being secured to the front wall 92 in any convenient manner such as by the use of angle supports 96. A bracket 98 may then be secured to the lock assembly 94 with the bracket having an upstanding member 100 positioned adjacent the upstanding member 76 on U-bracket 74. Captive screws 1022 may then be rotatably secured to the brackets 98 with threaded shank portions of the screws in threaded engagement with apertures in a slide block 104 which is slidably secured to the lock assembly 94. By rotating the captive screws 102, the vertical position of the slide block 104 may, thus, be varied to vary the height of a front opening beneath the cover 28 with the front opening being adjusted to fit the thickness of the article being dispensed.

For example, if the article being dispensed is a newspaper, the thickness of the newspaper will vary from one day to the next depending upon the quantity of classified advertisements. Also, the thickness of the newspaper may vary greatly as between the Sunday edition of the newspaper and the daily editions of the newspaper. By rotation of the captive screws 102, the height of the front opening beneath the cover 28 may, thus, be varied to suit the thickness of the newspaper, whether it be a thick Sunday newspaper or a relatively thin daily edition. When the captive screws 102 have been rotated to adjust the front opening beneath the cover 28 at a desired height, the position of the captive screws may then be fixed by contacting the captive screws with the support rods 78, as will be described. The plates 33 (see FIG. 1) may, then, be positioned above the captive screws 102 and the support rods 78 to prevent tampering with the captive screws and support rods.

As illustrated, the lock assembly 94 may be positioned in spaced relation from the front wall 92 by the angle supports 96. A cross closure 106 may, thus, be placed in the space between the lock assembly 94 and front wall 92.

Figure 3:
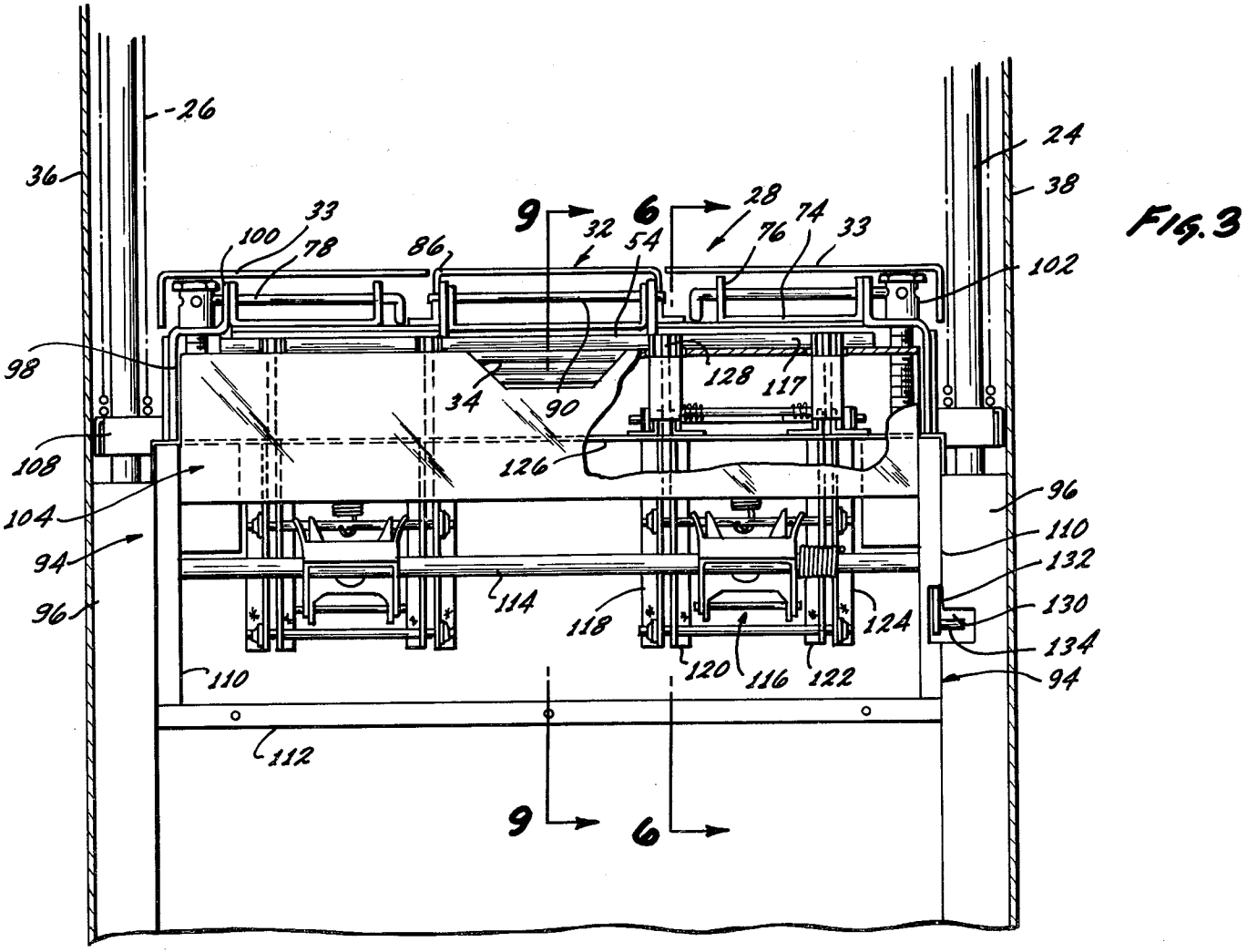
FIG. 3 is a vertical view taken along line 3—3 of FIG. 2 to illustrate a locking assembly for the protective cover.

Turning to FIG. 3, which is a partly sectioned front elevational view taken along line 3—3 of FIG. 2, a support platform 108 may be slidably positioned on the posts 24 with the platform being spring-biased to a raised position under the influence of springs 26. This biases the newspapers 54 which are carried by support platform 108 in an upward direction against the cover 28. As a single newspaper 54 is withdrawn from beneath the cover 28, a new newspaper is, thus, pushed upwardly against the cover by the support platform 108.

As shown, the slide block 104 may be slidably positioned between slide supports 110 formed on the lock assembly 94. Additionally, a cross member 112 may provide for transverse stiffening of the lock assembly 94. A rotatable shaft 114 may be rotatably positioned with respect to the lock assembly 94 with the shaft connected to a plurality of locking mechanisms 116. Each locking mechanism 116 may, thus, be independently actuated for locking front opening 117 between the cover 28 and slide block 104. With the opening 117 locked, it is impossible to withdraw a newspaper 54 through the opening.

As indicated, the locking mechanisms 116 may include a plurality of vertically positioned angle supports such as angle supports 118, 120, 122 and 124. Further, a cross plate 126 may extend between the slide supports 110 with the ends of the slide block 104 being open to permit movement of the slide block relative to the cross plate. Fingers 128 may then be slidably secured within slots formed between adjacent angle supports, such as supports 118 and 120 or supports 122 and 124 with the fingers in a raised position functioning to block the opening 117 and to prevent the withdrawal of a newspaper 54 through the opening.

As will be described, the vertical position of the fingers 128 may be controlled by rotation of the shaft 114. In rotating the shaft 114 to position the fingers 128 relative to the front opening 117, an aperture 130 in the lock mechanism 94 may permit the movement of a lever 132 and an actuating member 134 which is connected to the lever. By contacting the actuating member 134, as will be described, a rotational force may be transmitted through lever 132 to the shaft 114. In this manner, the locking mechanism 116 may be positioned in an unlocked mode to permit the withdrawal of a single newspaper 54 through the front opening 117. Following this, the fingers 128 are moved automatically to a raised position to prevent the withdrawal of a second newspaper through the opening 117. The lock mechanism 94, thus, functions to permit the withdrawal of only one newspaper 54 through the opening 117 during a vending operation.

Figure 4:
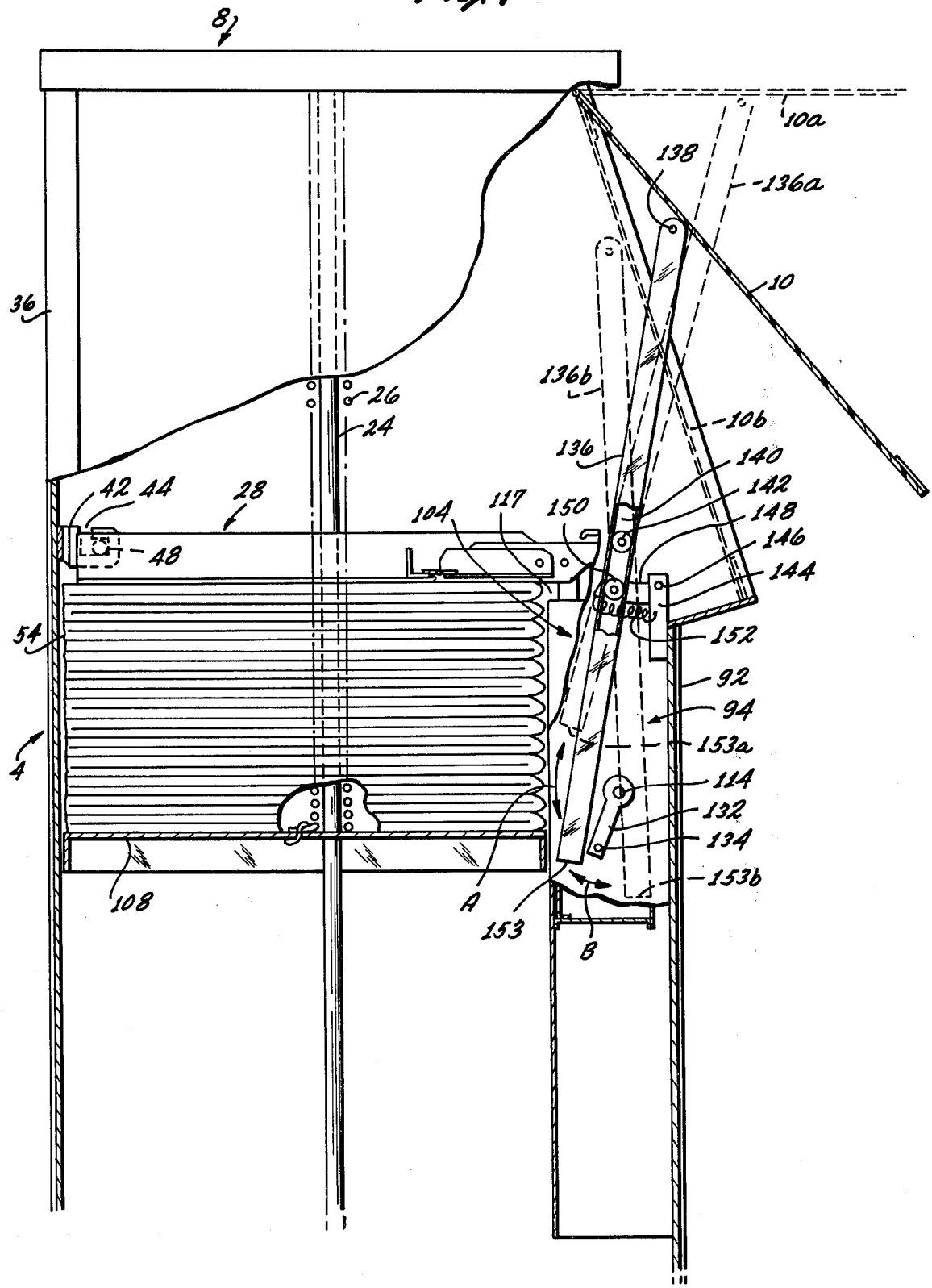
FIG. 4 is a side elevational view of the vending machine of FIG. 1 with parts broken away to illustrate the manner in which movement of the door for the display cabinet may be used to move the locking members out of the adjustable opening beneath the protective cover such that a single newspaper may then be withdrawn through the opening.

FIG. 4 is an end elevational view of the vending machine 2 as illustrated in FIG. 1 with portions of the structure being broken away while other portions are sectioned to illustrate the manner in which the movement of the lever 132 and actuating member 134 may be controlled through opening and closing of the door 10. As illustrated, an actuating lever 136 may be pivotally connected to the door 10 about a pivot 138 such that movement of the door produces movement of the actuating lever. The actuating lever 136 may include a slot 140 with a guide member 142 slidably received within the slot. Additionally, a bracket 144 may be fixedly connected to the front wall 92 by any suitable means, such as welding, etc., with the bracket including a pivot 146 about which an arm 148 is pivotally connected to the bracket. A guide roller 150 may be pivotally connected to the distal end of the arm 148 with the guide roller slidably supported within the slot 140. A spring 152 between the bracket 146 and the outer end of the arm 148 may, then, function to resiliently urge the arm in a counterclockwise direction from its position shown in FIG. 4.

Under the influence of the guide member 142 and the guide roller 150, the lever 136 may undergo a complex movement during movement of the door 10. With the door in the solid line position indicated as 10, the actuating lever occupies the solid line position indicated as 136. However, with continued upward movement of the door to a position indicated in phantom line drawing as 10*a*, the lever may move from the solid line position 136 to the phantom line position 136*a*. During this movement, the lower end 153 of lever 136 may move along a relatively steep vertical curved path indicated by the arrow A to a new position 153*a*. The relatively steep vertical curvature of the path indicated by arrow A prevents substantial inward movement of the lower lever end 153 with respect to the newspapers 54 within the storage compartment 4.

Similarly, during downward movement of the door from position 10*a* to position 10, the lower end moves downwardly along the steep curvature of the path indicated by arrow A from position 153*a* to position 153. During further downward movement of the door from solid line position 10 to the position indicated in phantom line drawing as 10*b*, the lower end undergoes movement from the solid line position 153 to the phantom line position 153*b*. During this movement, the lower end 153 moves along a relatively flat horizontally curved path indicated by arrow B. During this movement, the lower end 153 may contact the actuating member 134 to impart rotational movement through the lever 132 to the shaft 114. The shaft 114 may, thus, undergo rotational movement in a counterclockwise direction from its position as shown in FIG. 4. This rotational movement of shaft 114, as will be described, may unlock the locking mechanism 94 to permit the withdrawal of a single newspaper 54 through the front opening 117 between the cover 28 and the slide block 104.

Figure 5:
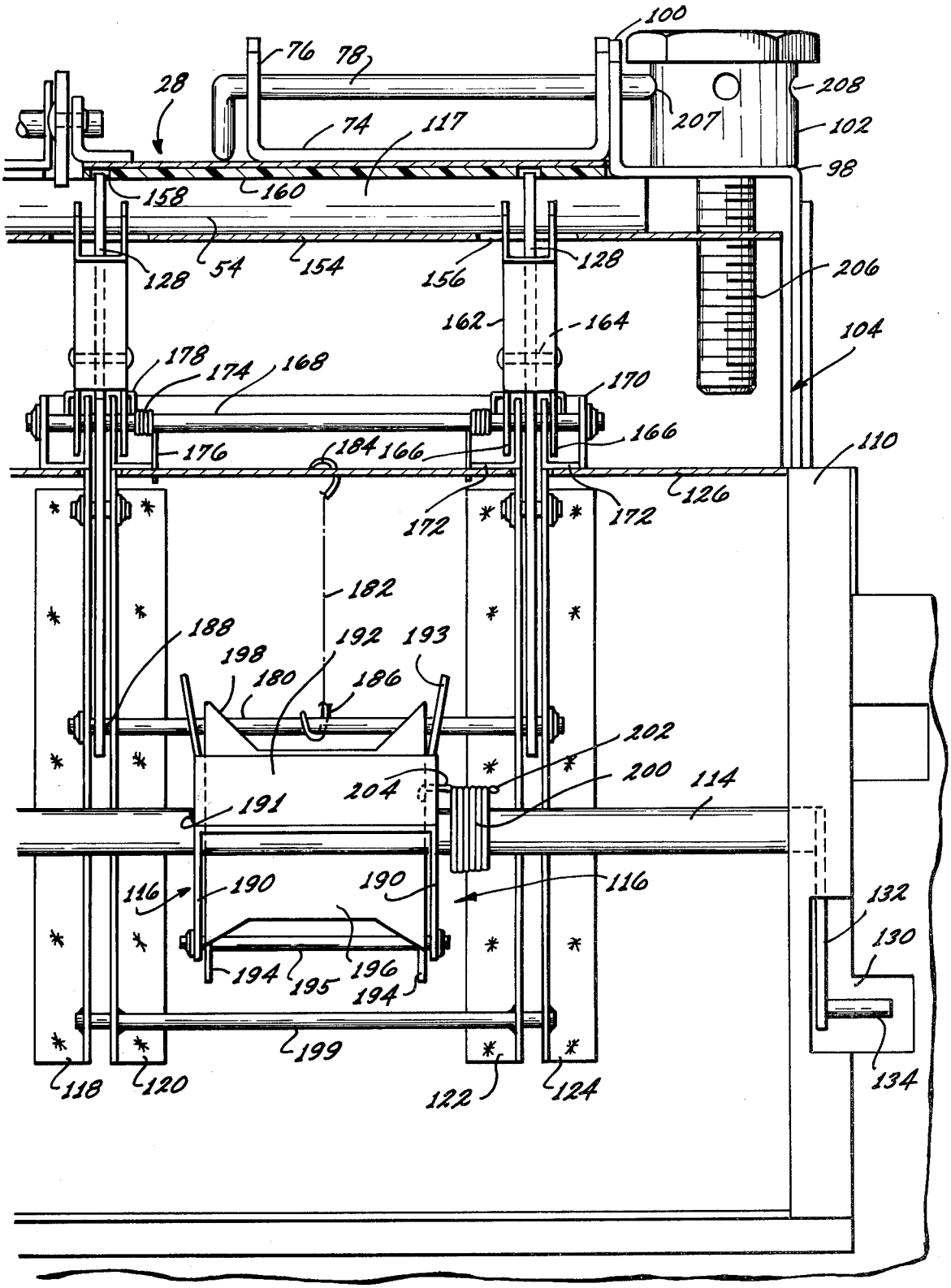
FIG. 5 is an enlarged elevational view, similar to FIG. 3, illustrating one of the locking mechanisms for the protective cover in greater detail.

FIG. 5, which is an enlarged elevational view of one of the locking mechanisms 116 shown in FIG. 3, illustrates the mechanism in a locked condition such that the fingers 128 lock the front opening 117 to prevent withdrawal of a newspaper 54 through the opening. The slide block 104, as previously indicated, may have open ends such that the slide block may be moved vertically relative to the cross plate 126. The slide block 104 includes an upper wall 154 having slots 156 therein through which the fingers 128 may protrude in blocking the front opening 117. With the fingers 128 extending through the slots 156, as illustrated in FIG. 5, the upper ends of the fingers may be received within depressions 158 which are formed in a facing member 160 of the cover 28. As indicated, the facing member 160 may be formed of a material, such as a plastic, which promotes a sliding action between a newspaper 54 and the facing member when the newspaper is withdrawn through the front opening 117. The transparent cover member 30, as described with regard to FIG. 1, may be positioned against the undersurface of the cover 28. In this case, the transparent cover member 30 may serve as the facing member 160 and may also serve as the transparent members 64.

U-shaped stop members 162 may be positioned adjacent to the fingers 138 with the stop members each having a stop pin 164 which functions to hold the fingers in a depressed position when the locking mechanism 116 is in an unlocked condition. The stop members 162 may each include bifurcated end portions 166 having aligned apertures therein which receive a shaft 168 such that the stop members are rotatably positioned on the shaft. The shaft 168 may be supported at each of its ends by a bracket 170 having apertures therein which receive the ends of the shaft. Additionally, intermediate support guides 172 may be spaced inwardly from the bifurcated ends 166 with the support guides having apertures which support the shaft 168 and with the support guides also serving to guide the movement of the fingers 128. Springs 174 may be connected to the stop members 162 to urge the stop members upwardly toward the fingers 128. As illustrated, the springs 174 may each have a fixed end 176 which is connected to the cross plate 126 and a movable end 178 which is connected to one of the stop members 162.

The lower ends of the fingers 128 may be connected together by a vertically movable rod 180 with the rod being urged upwardly by a spring 182 having an upper hook 184 connected to the cross plate 126 and a lower hook 186 connected to the rod. The rod 180 may be fixedly connected to the fingers 128 at connections 188 such that the rod and the fingers move in unison.

A pair of toggle levers 190 may be fixedly connected to the rotatable shaft 114 by any suitable means such as welds 191 with the toggle levers being joined together by a connecting plate 192. As indicated, the toggle levers 190 have upper ends 193 which overlie the movable rod 180 such that vertical movement of the rod produces rotational movement of the toggle levers which is transmitted to the shaft 114. Positioned inwardly of the toggle levers 190 are a pair of lock levers 194 which may be connected to the toggle levers through a bolt 195. Additionally, the lock levers 194 may be connected together by a connecting plate 196 with the upper ends 198 of the lock levers being rotatably secured to the movable rod 180.

Vertical movement of the rod 180 produces an upward movement of the lock levers 194 together with rotational movement of the toggle levers 190 which is transmitted to the lock levers by the bolt 195. A lock rod 199 may be joined in any suitable manner to the angle supports 118, 120, 122 and 124 as, for example, by welding. The lock rod 199 is, thus, fixedly positioned closely adjacent to the lower ends of the lock levers 194. With the fingers 128 in their raised position, as indicated in FIG. 5, which blocks the front opening 117, the lock rod 199 functions, as will be described, to prevent downward movement of the fingers. The lock rod 199 may, thus, fix the position of the fingers 128 to prevent removal of a newspaper 54 through the front opening 117 without first unlocking the locking mechanisms 116 through rotation of the shaft 114. As described in regard to FIG. 4, the shaft 114 may be rotated to unlock the locking mechanisms 116 by closing the door 10. This, then, sets the locking mechanisms 116 to permit the withdrawal of a newspaper 54 through the front opening 117 when the door 10 is subsequently opened by the insertion of the required number or combination of coins into the coin mechanism 12 (FIG. 1).

A spring 200 is positioned about the rotatable shaft 114 with the spring having a fixed end 202 and a movable end 204 which is connected to the rotatable shaft through the toggle levers 190. The spring 200 functions, as will be described, to bias the shaft 114 to a fixed rotational position in which the upper ends 193 of the toggle levers 190 are in engagement with the movable rod 180. Accordingly, when the shaft 114 is rotated to unlock the locking mechanism 116 through closing of the door 10 (FIG. 4), the position of the shaft is maintained in its rotated position by the spring 200. Thereafter, when the locking mechanism 116 is changed to its locked mode through upward movement of the rod 180 by the spring 182, the shaft 114 is rotated in a direction counter to the force exerted by the spring 200. As will be described, the spring 182 is much more powerful than the spring 200. Thus, in movement of the locking mechanism 116 to its locked mode, the force of the spring 182 overpowers the lesser force of the spring 200.

As described previously, the height of the front opening 117 may be adjusted by vertical movement of the slide block 104 relative to the slide supports 110. The captive screws 102 have threaded shanks 206 which engage threaded openings in the upper wall 154 of the slide block 104. The vertical position of the captive screws 102 is fixed through their contact with fixed brackets 98. Thus, on rotation of the captive screws 102, the slide block 104 is moved vertically with respect to the slide supports 110 to vary the height of the front opening 117. After adjusting the height of the front opening 117 to fit the thickness of the article which is being dispensed, the position of the captive screws 102 may then be fixed through contact of the ends 207 of the support rods 78 with one of a plurality of circumferentially spaced locating depressions 108 formed on the exterior surface of each of the captive screws 102. The support rods 78 may be fixed in their locked position by any of several known means. Thus, for example, the exterior of the support rods may be threaded to engage threaded apertures in the upstanding members 76 or the upstanding member 100. Also, the exterior surface of the support rod 78 may include a locking groove which receives a projection formed within any of the apertures through which the rod extends. Then, by rotation of the rod 78, the projection may ride up in the locking groove to lock the position of the rod with its end 207 in firm engagement with one of the locating depressions 208.

Figure 6:
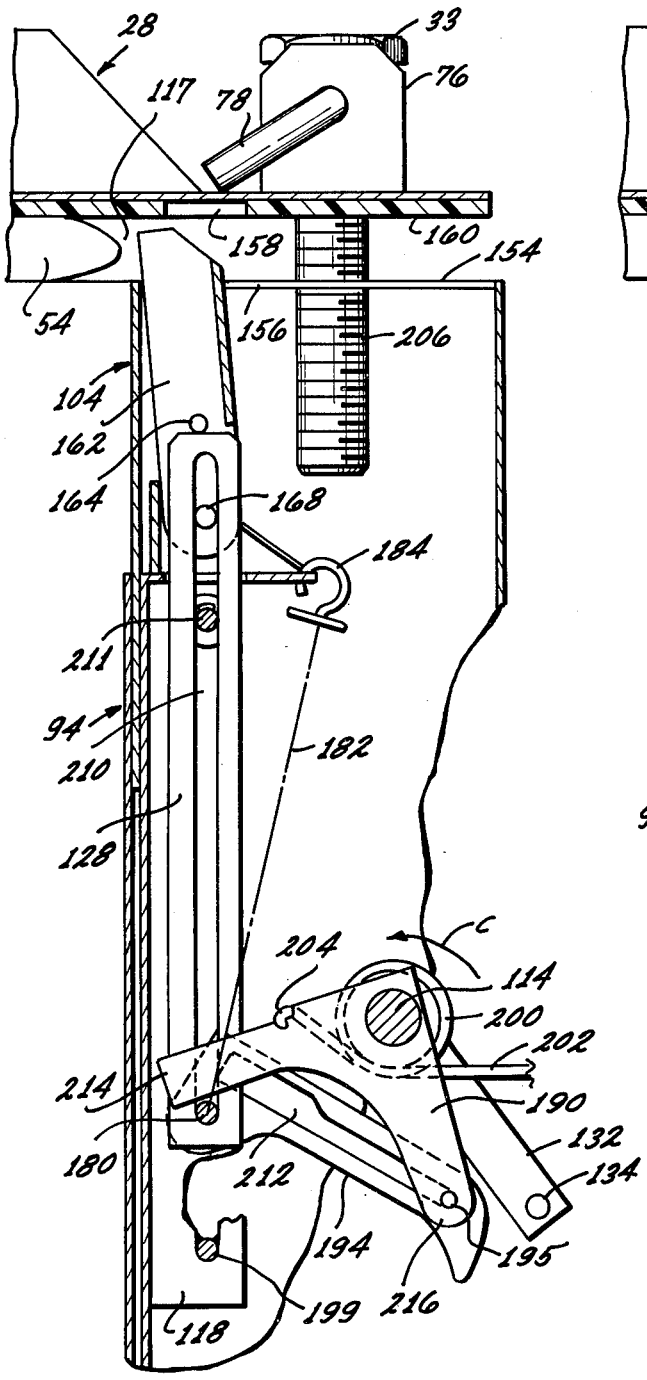
FIG. 6 is a sectional view taken along line 6—6 of FIG. 3, which illustrates the position of a rotatable shaft for actuation of a locking finger with the locking finger positioned out of the adjustable opening through contact of a stop member with the locking finger.

FIG. 6 is an enlarged elevational view of the lock assembly 94 taken along line 6—6 of FIG. 3 to illustrate the position of the elements with the locking mechanism in its unlocked mode. As described in regard to FIG. 4, when the door 10 is moved to its open position, the actuating lever 136 may contact the actuating member 134 to produce rotational movement of the shaft 114. The rotational movement of the shaft 114 may produce rotation in the direction of the arrow C as indicated in FIG. 6. As the shaft 114 rotates in the direction of arrow C, the fingers 128 are retracted or pulled downwardly with slots 210 in the fingers undergoing relative movement with respect to fixed guide pins 211. With the fingers 128 pulled downwardly to the extent shown in FIG. 6, the stop members 162 are rotated by the springs 174 (see FIG. 5) to position the stop pins 164 in contact with the upper surfaces of the fingers. This, then, fixes the fingers 128 in a downwardly retracted position.

In moving the fingers 128 downwardly, the bolt 195 which interconnects the toggle levers 190 and the lock levers 194 slides within slots 212 formed in the lock levers. This produces rotation of the lock levers 194 about the rod 180 to move the lock levers away from the lock rod 199. Additionally, as the shaft 114 is rotated in the direction of the arrow C, upper ends 214 on the toggle levers 190 are brought into contact with the rod 180. As previously described, the toggle levers 190 are fixedly connected to the shaft 114. Thus, the rotational movement of the shaft 114 is transmitted through the upper ends 214 to the fingers 128 so as to force the fingers downwardly against the force of the spring 182. The somewhat L-shaped configuration of the toggle levers 190 produces a transverse movement of the lower ends 216 of the toggle levers in a direction away from the angle support 118 during rotation of the shaft 114. This, as described, moves the lock levers 194 away from the lock rod 199. After rotation of the shaft 114 to place the toggle levers 190 in the position shown in FIG. 6, the spring 200 exerts a biasing force against the toggle levers 190 which tends to maintain the upper ends 214 of the toggle levers in contact with the rod 180 while also maintaining the shaft 114 in the rotational position indicated in FIG. 6.

Figure 7:
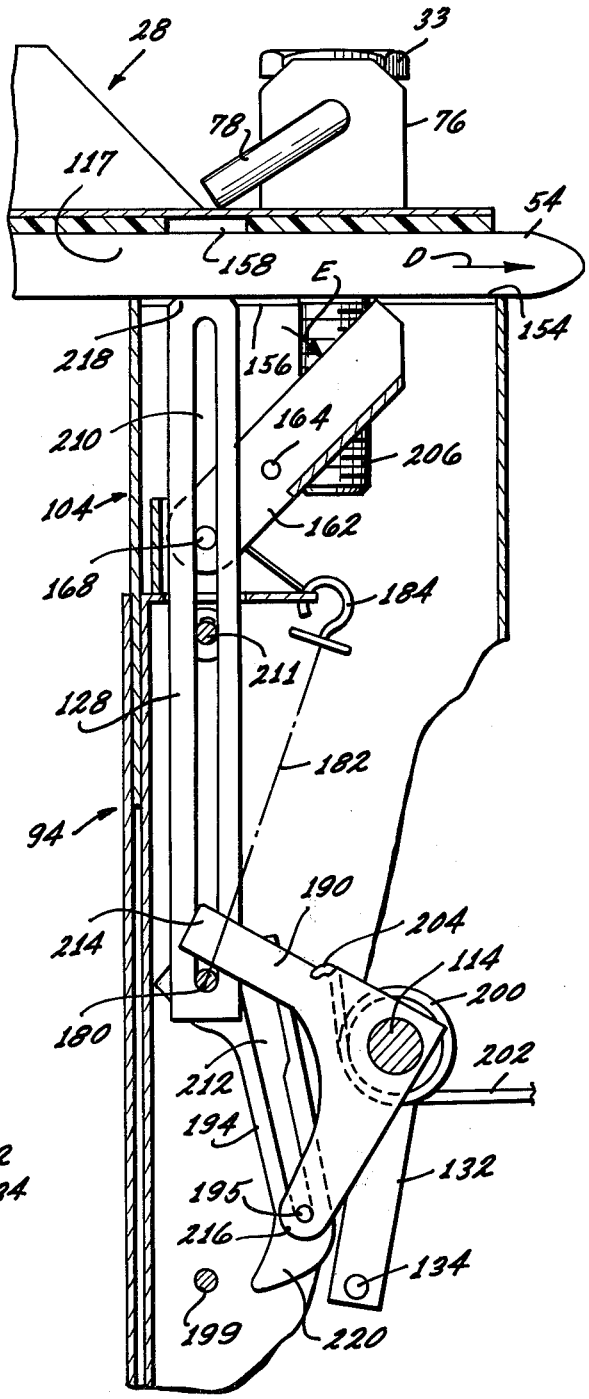
FIG. 7 is a sectional view, similar to FIG. 6, which illustrates movement of the stop member on being contacted with a newspaper withdrawn through the adjustable opening such that the locking finger is moved upwardly against the newspaper while the rotatable shaft used for actuation of the locking finger undergoes rotation through coaction of the locking finger with a toggle lever which may be carried by the rotatable shaft.

FIG. 7 is an elevational view of the lock mechanism 94, similar to FIG. 6, which illustrates the position of the elements as a single newspaper 54 is withdrawn through the front opening 117 between the cover 28 and the slide block 104. During its withdrawal, the newspaper 54 moves in the direction of the arrow D to contact the stop members 162 and to, thereby, produce rotation of the stop members in the direction indicated by the arrow E. This moves the stop pin 164 out of contact with the upper end of the finger 128 such that the finger is then moved upwardly from its position in FIG. 6 to that shown in FIG. 7 by contraction of the spring 182. As indicated, the upper ends of the fingers 128 may include a slanted surface 218 which contacts the surface of the newspaper 54 as it is drawn over the upper surface of the finger. The slanted surface 218, thus, serves to prevent tearing of the newspaper 54 by the pressure exerted against the newspaper through the finger 128.

As the finger 128 is moved upwardly to its position shown in FIG. 7, the rod 180 is moved into contact with the upper end 214 of toggle lever 190. Inasmuch as the spring 182 is stronger than the spring 200, the force which is imparted to the upper end 214 produces rotational movement of the shaft 114 in a direction opposite to that shown by the arrow C in FIG. 6. Additionally, the lower end 216 of the toggle lever 190 is moved in a transverse direction toward the lock rod 199 to bring the lower end 220 of the lock lever 194 into close proximity with the lock rod. As will be described, when the finger 128 is in a fully locked position, the lower end 220 is positioned closely adjacent to the lock rod 199 to prevent movement of the finger in a downward direction. During the withdrawal of the newspaper 54, as indicated in FIG. 7, the newspaper is itself in contact with the upper ends of the fingers 218 to maintain the fingers in a partly depressed and unlocked position.

Figure 8:
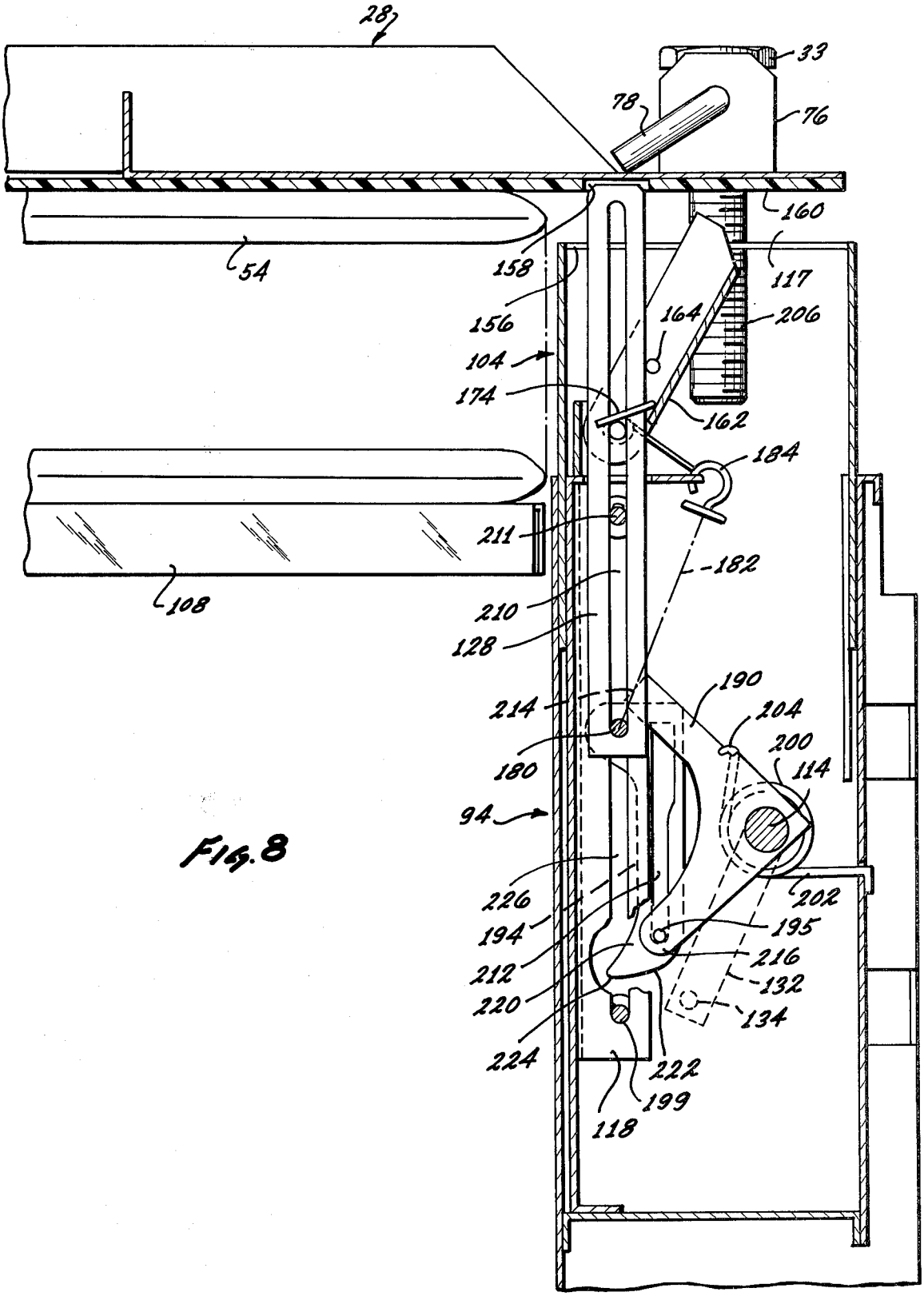
FIG. 8 is a sectional view, similar to FIGS. 6 and 7, which illustrates movement of a locking finger into the adjustable opening beneath the protective cover to lock the adjustable opening against withdrawal of a second newspaper with the locking finger maintained at an elevated position within the adjustable opening through the positioning of a lock lever with respect to a lock member.

FIG. 8 is an elevational view similar to FIGS. 6 and 7 which illustrates the position of the elements with the lock assembly 94 in a fully locked position after the withdrawal of a newspaper 54. By comparing the positions of the elements in FIG. 8 with the positions occupied in FIG. 7, it can be observed that the fingers 128 undergo further upward movement after withdrawal of a newspaper 54 to place the upper end of the finger within the depressions 158. With the upper end of finger 128 within the depression 158, a side force applied to the finger may be resisted by the contact between the finger and the depression. Also, with the finger 128 in its fully raised position, the lower end 220 of lock lever 194 is positioned closely adjacent to the lock rod 199. As indicated, the lower end 220 includes a curved surface 222 which curves gradually downwardly to a tip portion 224 which is transversely spaced from the axis of the lock lever 194.

In understanding the locking function of the lower end 220 with respect to the lock rod 199, it is believed useful to visualize the effect which would be produced by attempting to depress the finger 128 from its fully raised position shown in FIG. 8. If this were attempted, is an effort to slide another newspaper 54 through the front opening 117, the downward force exerted on the finger 128 would be transmitted to the rod 180 and then to the lock lever 194 which would bring the curved surface 222 into contact with the upper circumferential surface of the lock rod 199. This contact of the surface of lock rod 199 with the curved surface 222 would tend to move the tip 224 even further to the left than as shown in FIG. 8 which would establish an even firmer contact between the curved surface and the exterior surface of the lock rod. Accordingly, the configuration of the lower end 220, coupled with the position of the lower end relative to the lock rod 199, fixes the finger 128 in a raised position such that a downward force applied to the finger fixes the position of the finger even more firmly.

As further illustrated in FIG. 8, the angle supports which provide sliding support for the finger 128, such as support 118, may each contain longitudinal slots 226. The slots 226 permit sliding movement of the finger 128 relative to the support 118 with the rod 180 being slidable within the slot 226 during this movement.

When the elements of the lock assembly 94 are returned to an unlocked position, the shaft 114 is rotated in a counterclockwise direction from its position shown in FIG. 8 through contact of the lever 136 with the actuating member 134 as described in regard to FIG. 4. This, then, rotates the shaft in the direction of the arrow C as shown in FIG. 6. As this occurs, the upper end 214 of the toggle lever 190 exerts a downward force on the rod 180 while, at the same time, rotating the lock lever 194 to its position shown in FIG. 6 in which the lower end 220 of the lock lever is moved outwardly and away from the lock rod 199. At the same time, the stop members 162 are rotated by the springs 174 to the position shown in FIG. 6 in which stop pins 164 contact the upper surfaces of the fingers 128 to hold the fingers in a downwardly depressed position. With the elements of the lock assembly 94 returned to the position shown in FIG. 6, the spring 182 is in a stretched condition while the shaft 114 is maintained in its newly rotated position by the spring 200.

Figure 9:
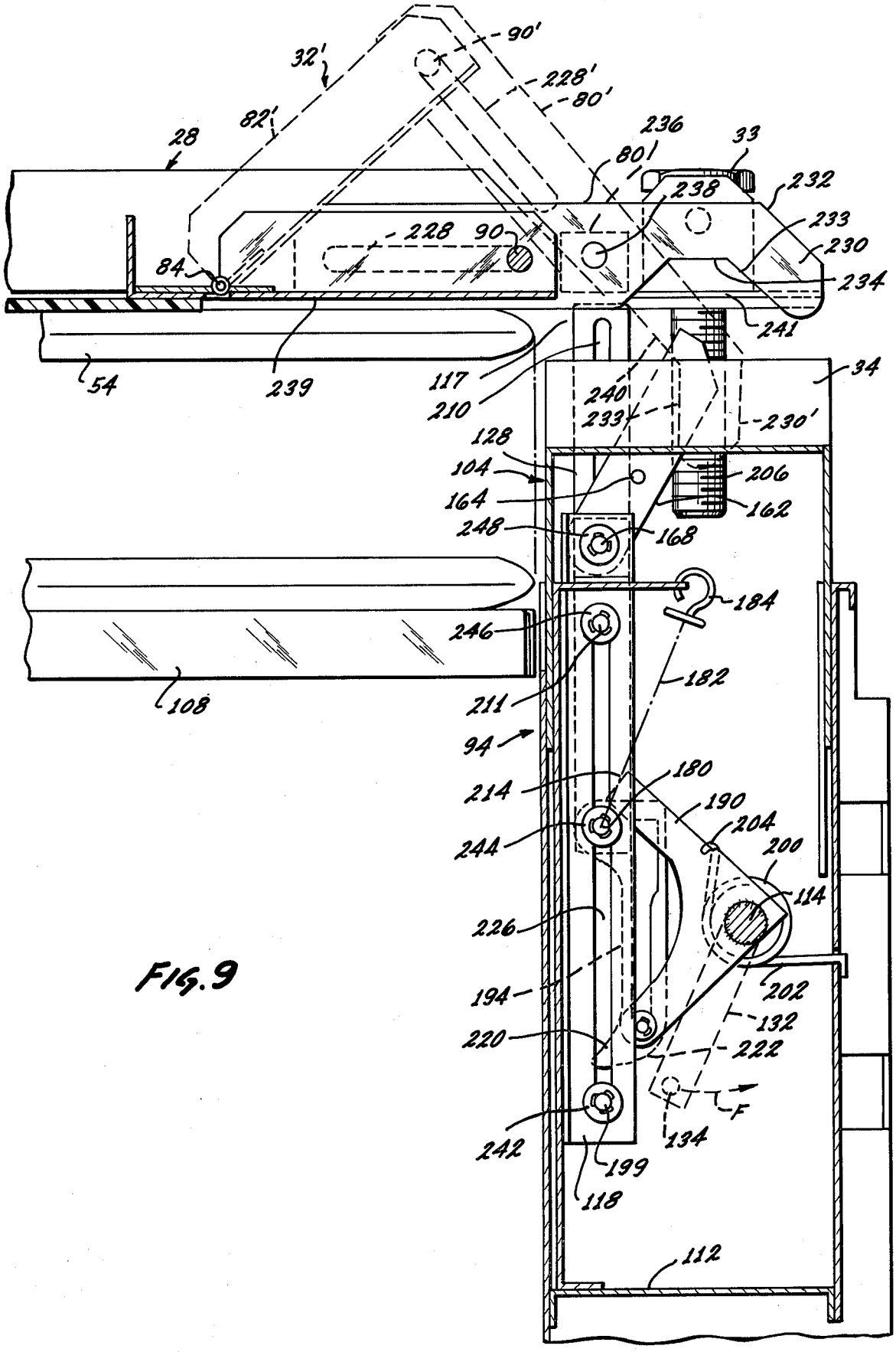
FIG. 9 is a side sectional view taken along line 9—9 of FIG. 3 which is similar to FIG. 8 and which illustrates the movement of a cover member to permit access to a portion of one newspaper in initiating its movement through the adjustable opening beneath the protective cover.

FIG. 9 is an elevational view of the lock assembly 94 and the cover 28 as taken along line 9—9 of FIG. 3 to illustrate the manner in which the cover may coact with the lock assembly in effectively preventing the removal of more than one newspaper 54 during a vending operation. The elements of the lock assembly 94 occupy the same positions in FIG. 9 as in FIG. 8. Thus, the discussion regarding the positions of the elements of the lock assembly 94 will not be repeated.

Turning to a discussion of the cover 28, in removing a newspaper 54 through the front opening 117 with the elements of the lock assembly 94 initially positioned as shown in FIG. 6, the lid 32 may first be rotated to a position shown in phantom line drawing as 32'. As the lid is moved to the raised position 32', the shaft 90 which interconnects the lid side members 82 with the lock members 80 (see FIG. 2) slides within grooves 228 which may be formed on the inner surfaces of the lock members. The lock members 80 may each terminate at a downwardly extending nose portion 230 which is connected to the remainder of the lock member by slanted surfaces 232 and 233. The slanted surface 233 leads to a recess 234 which may be formed in the undersurface of the lock member 80 with the lock members being rotatably connected to brackets 236 by pins 238. Since the lock members 80 may rotate about a fixed axis provided by the pins 238, during upward movement of the lid to the position 32', the lid moves relative to the lock members with the shaft 90 sliding upwardly to the position indicated as 90' within the upwardly inclined grooves whose position is indicated as 228'. When the shaft reaches the position indicated as 90', the upward movement of the lid terminates and the position of the lid at 32' represents the maximum upward movement of the lid. With the lid, thus, inclined upwardly to position 32', an opening 239 in the cover 28 is exposed which permits the user to grasp a single newspaper 54 by placing his hand beneath the raised lid and through the opening.

As the newspaper is, then, withdrawn through the front opening 117, the leading edge of the newspaper may contact a surface 240 formed within the lock member depression 234 since the upwardly inclined position of the lock member at 80' has rotated the lock member nose downwardly through a slot 241 in the cover 28 to a position 230' which lies within the front opening 117. The force of the leading edge of the newspaper 54 against the surface 240 may then force the downward rotation of the lock member in a counterclockwise direction from its upwardly inclined position 80'. The downward rotation of the lock member from its position 80' may then be transmitted through the groove 228 and the shaft 90 to the lid 32 to force downward rotation of the lid in a clockwise direction from its position 32'. Thus, the withdrawal of the newspaper 54 through the front opening 117 may force the closing of the lid 32 in order that the lock member nose portions 230 are withdrawn from the front opening.

During the withdrawal of a single newspaper 54 through the front opening 117, as shown in FIG. 7, the upper surfaces of the fingers 218 may be positioned against the undersurface of the newspaper which is being withdrawn. With the upper surfaces of the fingers 218, thus, being supported by the newspaper 54, it might be possible to keep the fingers in a depressed unlocked condition by feeding another newspaper into the front opening 117 closely behind the first newspaper which was being withdrawn. While the trailing edge of the first newspaper 54 was supported on portions of the upper surfaces of the fingers 218, the second newspaper could then be slid onto the exposed upper surfaces of the fingers which were not in contact with the first newspaper. In this manner, the entire newspaper supply within the machine could perhaps be removed in a stepwise fashion simply by feeding one newspaper closely behind another, through the front opening 117.

The above described manner of stealing newspapers by removing the newspapers in closely spaced sequence through the front opening 117 is effectively prevented by the mechanism of the cover 28 which is illustrated in FIG. 9. As illustrated, during the removal of a single newspaper 54 the lid 32 may be forced to a closed position such that it would be impossible to gain access to a second newspaper while the first newspaper was being pulled through the front opening 117. Thus, before the lid could be raised to the elevated position indicated as 32', it would be necessary to completely remove the first newspaper 54 which was being withdrawn through the front opening 117. On complete removal of the first newspaper 54 through the front opening 117, the fingers 128 would automatically move upwardly to their locked position illustrated in FIGS. 8 and 9. Thus, by the time that a second newspaper could be grasped by moving the lid to its upwardly inclined position 32', the locked upward position of the fingers 128 would prevent the removal of a second newspaper through the front opening 117.

In the functioning of the single vending machine as described in regard to FIGS. 3–9, the fingers 128 may be independently moved from an unlocked position as shown in FIG. 6 to a locked position as shown in FIGS. 8 or 9. With reference to FIGS. 6–8, when the stop member 162 for one of the fingers 128 is rotated in the direction of the arrow E shown in FIG. 7, that particular finger may be moved upwardly to a locked position as shown in FIGS. 8 and 9 while the other fingers remain in an unlocked position as shown in FIG. 6. This, then, prevents the theft of newspapers by, for example, twisting a newspaper 54 during its withdrawal through the front opening 117 such that the leading edge of the newspaper is positioned at an angle with respect to the various locking fingers.

If all of the locking fingers 128 were operated in unison, it might be possible, by twisting of a newspaper 54 during its withdrawal through the front opening 117, to prevent the movement of the fingers to a locked position by maintaining contact between one of the fingers and the newspaper. This would, then, permit the attempted withdrawal of a second newspaper 54 with contact being maintained between the first newspaper and one of the fingers 128 until such time as the second paper was partially withdrawn through the front opening 117. However, with each of the fingers 128 being independently movable to a locked position, a particular finger will move upwardly to its locked position as soon as it is no longer supported through contact with a newspaper 54 as shown in FIG. 7. Thus, as each finger 128 is released, it moves upwardly to the position shown in FIGS. 8 and 9 to effectively block the front opening 117 and to prevent the withdrawal of a second newspaper 54 through the front opening.

As described in FIGS. 6–8, when one of the fingers 128 moves upwardly to its locked position, it is accompanied by upward movement of the rod 180 and rotational movement of the shaft 114. As shown in FIG. 3, several locking mechanisms 116 may be connected to a common shaft 14. Thus, when one of the fingers 128 moves upwardly to a locked position, the accompanying rotation of the shaft 114 will have an effect upon the other fingers even though they may remain in an unlocked position.

Figure 10:
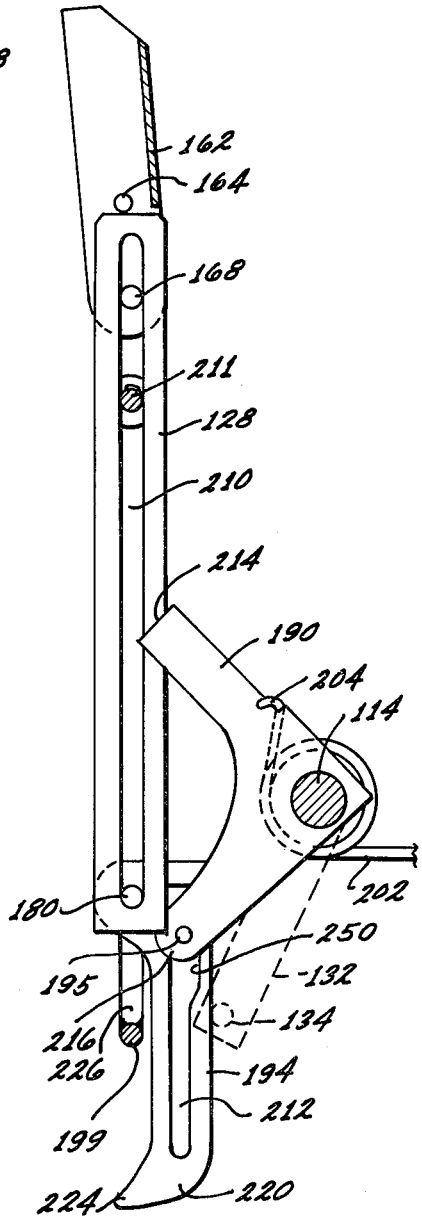
FIG. 10 is a side elevational view, similar to FIG. 6, which illustrates a locking finger in a downwardly retracted position through contact with a stop member while the rotatable shaft, a toggle lever connected thereto, and a lock lever connecting one end of the toggle lever with the locking finger have undergone movement due to upward movement of another locking finger (not shown) into the adjustable opening.

FIG. 10 is an elevational view which illustrates the effect of rotation of shaft 114 on a finger 128 which remains in an unlocked position while another finger has moved upwardly to a locked position. Since the upper end 214 of toggle lever 190 is not fixedly connected to the rod 180, the toggle lever is capable of movement which is independent of the rod 180. Accordingly, rotation of the shaft 114 may occur without affecting the position of the finger 128 shown in FIG. 10 which may remain in an unlocked position through contact of the stop pin 164 with the upper surface of the finger.

However, since the toggle lever 190 is connected to the lock lever 194 through the engagement of bolt 195 with slot 212, the rotational movement of the toggle lever will necessarily produce a change in the position of the lock lever. As illustrated, the length of the slot 212 is sufficiently great to accommodate the movement of the bolt 195 which is produced by the rotational movement of the toggle lever 190. With movement of the bolt 195 upwardly within the slot 212 to the position shown in FIG. 10, the lower end 220 of the lock lever 194 may undergo a transverse movement directed toward the lock rod 199. As a result of this movement, the tip portion 224 may then be positioned below the lock rod 199. If the unlocked finger 128 of FIG. 10 were to then be released by movement of the stop pin 164 out of engagement with the upper surface of the finger, the upward movement of the finger accompanied by upward movement of the rod 180 and lock lever 194 could cause the tip portion 224 to contact the undersurface of the lock rod 199. To permit the upward movement of the lock lever 194 under these circumstances, the slot 212 may include a relieved portion 250 where the slot is widened to permit some degree of play between the slot and the bolt 195. Thus, as the lock lever 194 is moved upwardly from its position shown in FIG. 10, the lock lever may undergo slight rotation in a counterclockwise direction to permit the lower end 220 to pass by the lock rod 199 with the lower end then being positioned above the lock rod with the finger 128 in its elevated and locked position.

As shown in FIG. 5, in a single locking mechanism 116, two fingers 128 may both be connected to a single rod 180. Thus, if one of the fingers 128 is moved upwardly to a locked position as in FIGS. 8 and 9, while the other finger remains in an unlocked position as in FIG. 10, the rod 180 will undergo a slight tilting motion. One end of the rod 180 will be raised along with the finger 128 which is moved to a locked position while the other end of the rod will remain in a lowered position along with the finger which remains in an unlocked position. This tilting movement may be permitted by the length and flexibility of the rod 180 as well as the flexibility of the toggle levers 190 and the connecting plate 192. Thus, two fingers 128 may be tied to a single locking mechanism 116 with the fingers being separately actuatable to a locked position.

As illustrated in the foregoing description, the cover 28 may be connected to a lock assembly 94 (see FIG. 3) with the cover and lock assembly being joined to the balance of the vending mechanism through mounting brackets 42 and angle supports 96 (see FIG. 2). In usage, the combination of the cover 28 together with the lock assembly 94, may be used to convert an existing vending mechanism of the prior art to a vending mechanism which is capable of vending one article at a time through an adjustable opening beneath the cover 28. In converting an existing vending mechanism to a single article vending mechanism, the construction of the door to the display cabinet (such as the door 10 shown in FIG. 4) may also be modified to include an actuating lever or similar means, such as lever 136 shown in FIG. 4, so that movement of the door may be used to unlock the adjustable opening 117 beneath the cover 28.

Thus, in addition to providing a single article vending machine, the present invention also provides a mechanism for converting a conventional vending machine to a single article vending machine. This is of considerable importance since there are presently a large number of conventional vending machines in existence. If the owners of the existing vending machines had to scrap their machines to progress to a single article vending machine, this would impose an economic hardship on the owners. However, this result is avoided by providing a means through which a conventional vending machine may be readily converted to a single article vending machine.

As a further aspect of the invention, the invention not only provides a single article vending machine, but also provides a method for vending articles one at a time from a vending machine. In accord with the method, a protective cover may be positioned above the articles to be dispensed with the protective cover positioned to provide an adjustable opening which leads to a region which contains a plurality of the articles. Locking members are then moved into the adjustable opening to lock the opening with the locking members being withdrawn from the opening when it is desired to vend a single article through the opening. The single article is then grasped and is withdrawn through the adjustable opening and, as the article is moved through the opening, the locking members are moved back into the opening. This, then, locks the adjustable opening such that a second article cannot be withdrawn through the opening.

In adding newspapers to my vending machine, the front of the cover 28 may be released by unthreading the captive screws 102 and the cover may be rotated upwardly and rearwardly through rotation of rod 48 (FIG. 2).

I claim:

1. A single article vending machine comprising:

means for storing a plurality of articles in stacked relation;

means providing an adjustable opening in communication with said means for storing articles;

means to adjust said opening to a dimension which corresponds with the thickness of one of said articles, and means to lock said opening including a plurality of locking members;

said locking members being movable into said opening to block the opening such that the opening is locked;

means to move said locking members out of said opening such that the opening is unlocked to permit the withdrawal of one of said articles through said opening, and means actuatable by the movement of one of said articles through said opening to move said locking members toward said opening for locking the opening after the one article is moved through the opening, whereby, a single article may be dispensed through the opening with the locking members moved out of the opening with the passage of a single article through the opening moving the locking members into the opening to prevent the withdrawal of a second article through the opening.

2. The vending machine of claim 1 wherein said locking members are individually actuatable such that one of said members may move into the opening to lock the opening while other of said locking members are positioned out of said opening.

3. The vending machine of claim 1 including an enclosure positioned about said adjustable opening;

a door to said enclosure;

a coin mechanism which permits the opening of said door when a predetermined number or denomination of coins is received by the coin mechanism, and means interconnecting the movement of said door with the means to move the locking members out of said opening such that the locking members are positioned out of said opening each time the door is opened by the insertion of coins in said coin mechanism.

4. The vending machine of claim 3 including means to hold the locking members out of said opening when said opening is unlocked, and means interconnecting said means to hold the locking members out of the opening with said means actuatable by the movement of one of said articles through said opening, whereby the means to hold the locking members out of the opening are actuated by the movement of one of said articles through the opening to permit the movement of the locking members into the opening and to lock the opening to prevent the withdrawal of a second article through the opening.

5. The vending machine of claim 3 including means to provide access to a portion of one of said articles to permit grasping of said one article with said door being open in pulling the article through said opening with the opening unlocked and the locking members moved out of said opening.

6. The vending machine of claim 5 including means to prevent access to said articles as one of said articles is being withdrawn through said opening, whereby access is provided to a portion of one of said articles in grasping the article and initiating its movement through said opening with access to said articles then being prevented as the one article is withdrawn through the opening such that grasping of an article is permitted only in initiating its movement through the opening.

7. The vending machine of claim 1 including means to hold the locking members out of said opening when said opening is unlocked, and means interconnecting said means to hold the locking members out of the opening with said means actuatable by the movement of one of said articles through said opening, whereby the means to hold the locking members out of the opening are actuated by the movement of one of said articles through the opening to permit the movement of the locking members into the opening and to lock the opening to prevent the withdrawal of a second article through the opening.

8. The vending machine of claim 7 wherein said locking members are individually actuatable such that one of said members may move into the opening to lock the opening while other of said locking members are positioned out of said opening.

9. The vending machine of claim 1 including means to provide access to a portion of one of said articles to permit grasping of said one article in pulling the article through said opening with the opening unlocked and the locking members moved out of said opening.

10. The vending machine of claim 9 including means to prevent access to said articles as one of said articles is being withdrawn through said opening, whereby access is provided to a portion of one of said articles in grasping the article and initiating its movement through said opening with access to said articles then being prevented as the one article is withdrawn through the opening such that grasping of an article is permitted only in initiating its movement through the opening.

11. The vending machine of claim 10 wherein said locking members are individually actuatable such that one of said members may move into the opening to lock the opening while other of said locking members are positioned out of said opening.

12. A single article vending machine comprising means for storing a plurality of articles is stacked relation;

means providing an adjustable opening in communication with said means for storing articles;

means to adjust said opening to a dimension which corresponds with the thickness of one of said articles, and means to lock said opening including a plurality of locking fingers positioned for movement into or out of said opening;

a rotatable shaft;

a plurality of toggle levers connected to said shaft;

means to bias said locking fingers for movement into said opening;

a plurality of movable stop members;

said stop members being movable between a first position with the stop members contacting said fingers to hold the fingers in a retracted position out of said opening and a second position with the stop members positioned out of contact with said fingers and with the fingers extending into the opening;

means to bias said stop members toward said first position;

said toggle levers coacting said locking fingers such that rotation of said shaft in one direction moves said locking fingers out of said opening with said stop members moving to said first position to hold the fingers in a retracted position;

said stop members extending into said opening with the stop members in said first position, and said stop members being movable to said second position on contact with an article being withdrawn through said opening, whereby movement of an article through said opening moves the stop members to said second position with said fingers moving into the opening to lock the opening and to prevent the withdrawal of a second article through the opening.

13. The vending machine of claim 12 including means to bias said shaft in said one direction such that the rotational position of the shaft remains fixed with the locking fingers moved out of said opening.

14. The vending machine of claim 12 wherein said locking fingers are individually actuatable such that one of said fingers may move into said opening to lock the opening on movement of the stop member for that finger to its second position while other of said fingers are in a retracted position out of said opening with the stop members for these fingers positioned in their first position.

15. The vending machine of claim 12 including an enclosure positioned about said adjustable opening;

a door to said enclosure;

a coin mechanism which permits the opening of said door when a predetermined number or denomination of coins is received by the coin mechanism, and means interconnecting the movement of said door with the rotation of said shaft in said one direction such that the locking fingers are positioned out of said opening each time the door is opened by the insertion of coins in said coin mechanism.

16. The vending machine of claim 12 including means to prevent the retraction of said fingers out of said opening without rotation of said shaft.

17. The vending machine of claim 16 wherein said locking fingers are individually actuatable such that one of said fingers may move into said opening to lock the opening on movement of the stop member for that finger to its second position while other of said fingers are in a retracted position out of said opening with the stop members for these fingers positioned in their first position.

18. The vending machine of claim 12 including a plurality of lock levers;

each of said lock levers being pivotally connected at one end to a toggle lever;

each of said lock levers being pivotally connected at another end to a locking finger;

a locking member positioned for contact with said lock levers;

said toggle levers being shaped and positioned to move said lock levers into locking proximity with said locking member on rotation of said shaft in a direction opposite to said one direction.

19. The vending machine of claim 18 wherein said locking fingers are individually actuatable such that one of said fingers may move into said opening to lock the opening on movement of the stop member for that finger to its second position while other of said fingers are in a retracted position out of said opening with the stop members for these fingers positioned in their first position.

20. The vending machine of claim 19 including means interconnecting said lock levers and said toggle levers to permit movement of the lock levers for the fingers which are in a retracted position to a position which is not in locking proximity to said locking member while the lock levers for fingers which move into said opening to lock the opening are moved into locking proximity with said locking member.

21. The vending machine of claim 12 including means to provide access to a portion of one of said articles to permit grasping of said one article in pulling the article through said opening with the locking fingers held in a retracted position out of said opening by said stop members.

22. The vending machine of claim 21 including means to prevent access to said articles as one of said articles is being withdrawn through said opening, whereby access is provided to a portion of one of said articles in grasping the article and initiating its movement through said opening with access to said articles then being prevented as the one article is withdrawn through the opening such that grasping of an article is permitted only in initiating its movement through the opening.

23. A protective lockable cover for insertion in a vending machine to convert the vending machine to a single article vending machine, said cover comprising:

a cover member;

a movable base member positioned in spaced relation to said cover member;

means to adjust the spacing between said cover member and said base member to provide an opening therebetween which has a dimension that corresponds with the thickness of one of a plurality of articles to be dispensed one at a time through said opening, and means to lock said opening including a plurality of locking members;

said locking members being movable into said opening to block the opening such that the opening is locked;

means to move said locking members out of said opening such that the opening is unlocked to permit the withdrawal of one of said articles through said opening, and means actuatable by the movement of one of said articles through said opening to move said locking members toward said opening for locking the opening after the one article is moved through the opening, whereby a single article may be dispensed through the opening with the locking members moved out of the opening with the passage of a single article through the opening moving the locking members into the opening to prevent the withdrawal of a second article through the opening.

24. The protective cover of claim 23 wherein said locking members are individually actuatable such that one of said members may move into the opening to lock the opening while other of said locking members are positioned out of said opening.

25. The protective cover of claim 23 including means to hold the locking members out of said opening when said opening is unlocked, and means interconnecting said means to hold the locking members out of the opening with said means actuatable by the movement of one of said articles through said opening, whereby the means to hold the locking members out of the opening are actuated by the movement of one of said articles through the opening to permit the movement of the locking members into the opening and to lock the opening to prevent the withdrawal of a second article through the opening.

26. The protective cover of claim 24 wherein said locking members are individually actuatable such that one of said members may move into the opening to lock the opening while other of said locking members are positioned out of said opening.

27. The protective cover of claim 23 including means to provide access to a portion of one of said articles to permit grasping of said one article in pulling the article through said opening with the opening unlocked and the locking members moved out of said opening.

28. The protective cover of claim 27 including means to prevent access to said articles as one of said articles is being withdrawn through said opening, whereby access is provided to a portion of one of said articles in grasping the article and initiating its movement through said opening with access to said articles then being prevented as the one article is withdrawn through the opening such that grasping of an article is permitted only in initiating its movement through the opening.

29. The protective cover of claim 25 wherein said locking members are individually actuatable such that one of said members may move into the opening to lock the opening while other of said locking members are positioned out of said opening.

30. A protective lockable cover for insertion in a vending machine to convert the vending machine to a single article vending machine, said cover comprising:

a cover member;

a movable base member positioned in spaced relation to said cover member;

means to adjust the spacing between said cover member and said base member to provide an opening therebetween which has a dimension that corresponds with the thickness of one of a plurality of articles to be dispensed one at a time through said opening, and means to lock said opening including a plurality of locking fingers positioned for movement into or out of said opening;

a rotatable shaft;

a plurality of toggle levers connected to said shaft;

means to bias said locking fingers for movement into said opening;

a plurality of movable stop members;

said stop members being movable between a first position with the stop members contacting said fingers to hold the fingers in a retracted position out of said opening and a second position with the stop members positioned out of contact with said fingers and with the fingers extending into the opening;

means to bias said stop members toward said first position;

said toggle levers coacting said locking fingers such that rotation of said shaft in one direction moves said locking fingers out of said opening with said stop members moving to said first position to hold the fingers in a retracted position;

said stop members extending into said opening with the stop members in said first position, and said stop members being movable to said second position on contact with an article being withdrawn through said opening, whereby movement of an article through said opening moves the stop members to said second position with said fingers moving into the opening to lock the opening and to prevent the withdrawal of a second article through the opening.

31. The protective cover of claim 30 including means to bias said shaft in said one direction such that the rotational position of the shaft remains fixed with the locking fingers moved out of said opening.

32. The protective cover of claim 30 wherein said locking fingers are individually actuatable such that one of said fingers may move into said opening to lock the opening on movement of the stop member for that finger to its second position while other of said fingers are in a retracted position out of said opening with the stop members for these fingers positioned in their first position.

33. The protective cover of claim 30 including means to prevent the retraction of said fingers out of said opening without rotation of said shaft.

34. The protective cover of claim 33 wherein said locking fingers are individually actuatable such that one of said fingers may move into said opening to lock the opening on movement of the stop member for that finger to its second position while other of said fingers are in a retracted position out of said opening with the stop members for these fingers positioned in their first position.

35. The protective cover of claim 30 including a plurality of lock levers;

each of said lock levers being pivotally connected at one end to a toggle lever;

each of said lock levers being pivotally connected at another end to a locking finger;

a locking member positioned for contact with said lock levers;

said toggle levers being shaped and positioned to move said lock levers into locking proximity with said locking member on rotation of said shaft in a direction opposite to said one direction.

36. The protective cover of claim 33 wherein said locking fingers are individually actuatable such that one of said fingers may move into said opening to lock the opening on movement of the stop member for that finger to its second position while other of said fingers are in a retracted position out of said opening with the stop members for these fingers positioned in their first position.

37. The protective cover of claim 36 including means interconnecting said lock levers and said toggle levers to permit movement of the lock levers for the fingers which are in a retracted position to a position which is not in locking proximity to said locking member while the lock levers for fingers which move into said opening to lock the opening are moved into locking proximity with said locking member.

38. The protective cover of claim 30 including means to provide access to a portion of one of said articles to permit grasping of said one article in pulling the article through said opening with the locking fingers held in a retracted position out of said opening by said stop members.

39. The vending machine of claim 38 including means to prevent access to said articles as one of said articles is being withdrawn through said opening, whereby access is provided to a portion of one of said articles in grasping the article and initiating its movement through said opening with access to said articles then being prevented as the one article is withdrawn through the opening such that grasping of an article is permitted only in initiating its movement through the opening.

40. A method for vending a plurality of articles with the articles being vended one at a time, said method comprising:

providing an enclosed region to storing a plurality of articles in stacked relation;

providing an adjustable opening to said enclosed region;

adjusting said opening to a dimension which corresponds to the thickness of one of said articles;

providing locking members which are movable into or out of said adjustable opening;

grasping one of said articles and withdrawing said one article through said adjustable opening with the locking members positioned out of the opening, and moving said locking members toward said opening for locking the one article is withdrawn through said opening, whereby, the opening is locked by said locking members after the withdrawal of said one article through the opening.

41. The method of claim 40 including providing an enclosure about said adjustable opening;

providing a door to said enclosure;

providing a coin mechanism which is interconnected with said door to permit opening of the door when a predetermined number or denomination of coins is received by said coin mechanism, and interconnecting the movement of said door with the movement of said locking members such that the locking members are positioned out of said opening each time the door is opened by the insertion of coins in said coin mechanism.

42. The method of claim 40 including holding said locking members out of said opening prior to the withdrawal of said one article through the opening;

moving the locking members toward said opening with a resilient biasing force as the article which is being withdrawn is moved over the locking members, and supporting the locking members against the one article as it is withdrawn through said opening, whereby, as the one article moves past a locking member during withdrawal of the article through said opening, the unsupported locking member moves into said opening to lock the opening and to prevent the withdrawal of a second article through the opening.

43. The method of claim 40 including the step of holding the locking members within the opening when the opening is locked such that the locking members cannot be removed from the opening by grasping the locking members and applying a force against the locking members which is directed away from said opening.

44. The method of claim 40 including individually moving said locking members toward the opening as one article is withdrawn through the opening, whereby, one of the locking members may move into the opening to blodk the opening after passage of the one article by the locking member while other of the locking members are positioned out of the opening.

45. The method of claim 40 including the step of providing access to a portion of said one article to facilitate grasping of the article as the withdrawal of the article through the opening is initiated.

46. The method of claim 45 including the step of removing access to said articles as said one article is being withdrawn through said opening, whereby, access is provided to a portion of said one article to initiate its withdrawal through said opening with access to the articles being removed as the one article is withdrawn through the opening such that grasping of an article is permitted only in initiating its movement through the opening.

47. The method of claim 40 including moving the locking members out of said opening prior to the withdrawal of one article through the opening.

48. The method of claim 47 including providing a rotatable shaft whose rotational movement coacts with the movement of said locking members, and rotating said shaft in one direction to move the locking members out of said opening.

49. The method of claim 48 including providing an enclosure about said adjustable opening;

providing a door to said enclosure;

providing a coin mechanism which is interconnected with said door to permit opening of the door when a predetermined number or denomination of coins is received by said coin mechanism, and interconnecting the movement of said door with the rotation of said shaft such that movement of the door rotates the shaft in said one direction to move the locking members out of said opening, whereby, the locking members are positioned out of said opening each time the door is opened by the insertion of coins in said coin mechanism.

50. The method of claim 48 including the step of resiliently biasing the shaft in said one direction such that the shaft is resiliently biased to a fixed position after rotation of said shaft in said one direction to move the locking members out of said opening.

* * * * *